US012590423B2

(12) United States Patent
Engels

(10) Patent No.: US 12,590,423 B2
(45) Date of Patent: Mar. 31, 2026

(54) EDGE SLUMP CONTROL

(71) Applicant: Wirtgen GmbH, Windhagen (DE)

(72) Inventor: Michael Engels, Montabaur (DE)

(73) Assignee: Wirtgen GmbH, Windhagen (DE)

( * ) Notice: Subject to any disclaimer, the term of this patent is extended or adjusted under 35 U.S.C. 154(b) by 515 days.

(21) Appl. No.: 18/365,583

(22) Filed: Aug. 4, 2023

(65) Prior Publication Data

US 2025/0043523 A1 Feb. 6, 2025

(51) Int. Cl.

*E01C 19/48* (2006.01)
*E01C 19/50* (2006.01)
*E01C 23/01* (2006.01)

(52) U.S. Cl.

CPC ..... *E01C 19/4893* (2013.01); *E01C 19/4853* (2013.01); *E01C 19/506* (2013.01); *E01C 23/01* (2013.01)

(58) Field of Classification Search

CPC .. E01C 19/48; E01C 19/4856; E01C 19/4893; E01C 19/506
USPC ..... 404/105
See application file for complete search history.

(56) References Cited

U.S. PATENT DOCUMENTS 3,605,579 A 9/1971 Heltzel
3,710,695 A * 1/1973 Miller ..... E01C 19/4893 404/105
3,850,541 A 11/1974 Baillet et al.
3,970,405 A 7/1976 Swisher, Jr. et al.
4,798,495 A 1/1989 Laeuppi et al.
5,101,360 A 3/1992 Bennett
5,190,397 A 3/1993 Bengford et al.
5,209,602 A 5/1993 Godbersen
5,405,212 A 4/1995 Swisher et al.
5,567,075 A * 10/1996 Allen ..... E01C 19/006 404/102
5,568,992 A 10/1996 Grembowicz et al.

(Continued)

FOREIGN PATENT DOCUMENTS

CN 113416035 B * 7/2022 ..... C04B 28/04
DE 3032495 A1 4/1982
GB 1242856 A * 8/1971 ..... E01C 19/407

OTHER PUBLICATIONS

European Search Report for corresponding patent application No. 24192545.2, dated Dec. 17, 2024, 9 pages (not prior art).

(Continued)

*Primary Examiner* — Gary S Hartmann
(74) *Attorney, Agent, or Firm* — Lucian Wayne Beavers; Patterson Intellectual Property Law, PC

(57) ABSTRACT

Methods and apparatus for controlling edge slump in newly formed concrete structures formed by a slip form paving machine. An edge height sensor generates an edge height signal corresponding to a height of an edge of the newly formed concrete structure to thereby detect a slumping of the edge of the newly formed concrete structure behind a slip form paver mold. A controller receives the edge height signal, determines whether any slumping of the edge of the newly formed concrete structure exceeds a set slump limit, and automatically controls an actuator assembly at least in part in response to the edge height signal to adjust the height of a lateral edge portion of a mold bottom plate relative to an interior portion of the mold bottom plate and thereby adjust the height of the edge of the newly formed concrete structure.

25 Claims, 15 Drawing Sheets

(56) References Cited

U.S. PATENT DOCUMENTS

| | | | | |
|---|---|---|---|---|
| 5,588,776 | A * | 12/1996 | Swisher, Jr. | E01C 23/04 404/101 |
| 5,924,817 | A | 7/1999 | Godbersen | |
| 5,941,659 | A | 8/1999 | Godbersen | |
| 6,176,643 | B1 | 1/2001 | Guntert et al. | |
| 6,390,726 | B1 | 5/2002 | Guntert et al. | |
| 6,390,727 | B1 | 5/2002 | Guntert et al. | |
| 6,597,037 | B1 | 7/2003 | Forbes et al. | |
| 6,655,869 | B1 | 12/2003 | Deeb et al. | |
| 7,037,035 | B2 | 5/2006 | Casters | |
| 7,136,522 | B2 | 11/2006 | Harrington et al. | |
| 8,382,396 | B2 | 2/2013 | Francis et al. | |
| 8,613,566 | B2 | 12/2013 | Fritz et al. | |
| 8,989,968 | B2 | 3/2015 | Fritz et al. | |
| 9,039,322 | B2 | 5/2015 | Francis et al. | |
| 9,051,696 | B1 | 6/2015 | Coats et al. | |
| 9,096,977 | B2 | 8/2015 | Fritz et al. | |
| 9,359,726 | B2 | 6/2016 | Francis et al. | |
| 9,395,726 | B1 | 7/2016 | Rizzi et al. | |
| 9,404,228 | B1 | 8/2016 | Coats et al. | |
| 9,551,115 | B2 | 1/2017 | Engels et al. | |
| 10,132,046 | B2 | 11/2018 | Thieme et al. | |
| 10,253,461 | B2 | 4/2019 | Engels et al. | |
| 10,738,421 | B2 | 8/2020 | Guntert, Jr. et al. | |
| 11,193,244 | B2 | 12/2021 | Guntert, Jr. et al. | |
| 11,421,389 | B2 * | 8/2022 | Engels | E01C 19/4893 |
| 2001/0041094 | A1 | 11/2001 | Guntert, Jr. et al. | |
| 2006/0204334 | A1 | 9/2006 | Guntert et al. | |
| 2010/0150650 | A1 | 6/2010 | Buschmann et al. | |
| 2016/0115654 | A1 | 4/2016 | Pedersen et al. | |
| 2016/0177519 | A1 | 6/2016 | Fritz et al. | |
| 2021/0010211 | A1 | 1/2021 | Fritz | |
| 2025/0012022 | A1 * | 1/2025 | Engels | E01C 19/40 |

OTHER PUBLICATIONS

D. Castro-Lacourute and L. S. Bryson, C. Maynard, R. L. Williams II and P. Bosscher, Concrete Paving Productivity Improvement Using a Multi-Task Autonomous Robot, 24th International Symposium on Automation & Robotics in Construction (ISARC 2007) Construction Automation Group, I.I.T. Madras, 7 pages.

Gomaco GP-4000 brochure (28 pages) (2016).

"Troubleshooting Slipform Paver Operations" D. Clausen, Published by The Aberdeen Group (1997)(4 pages).

"The Paving Operation", ConPave, (22 pages)(undated but admitted to be prior art).

* cited by examiner

EDGE SLUMP CONTROL

BACKGROUND OF THE INVENTION

1. Field of the Invention

The present application relates to methods and apparatus for slip form paving and particularly to methods and apparatus for controlling slumping of the outer edge of a newly formed concrete structure.

2. Description of the Prior Art

FIGS. 1-7 illustrate a prior art slip form paving machine and show the manner in which the prior art has addressed the problem of controlling edge slump in slip formed concrete structures. In FIG. 1, a slip form paver apparatus is shown and generally designated by the number 10. As is schematically illustrated in FIG. 2 the apparatus 10 is configured to move in a paving direction 12 across a ground surface 14 for spreading, leveling and finishing concrete into a newly formed concrete structure 16 having a generally upwardly exposed concrete surface 18 and terminating in lateral concrete sides such as 20.

The slip form paver apparatus 10 includes a main frame 22 and a slip form paver mold 24 supported from the main frame 22. Left and right side form assemblies 26 and 28 are connected to the slip form paver mold 24 to close the slip form paver mold 24 on the left and right sides to form the lateral concrete sides such as 20 of the finished concrete structure 16. One or more trailing side forms 44 may follow each of the side form assemblies 26 and 28 as best seen in FIG. 3.

The main frame 22 is supported from the ground surface by a plurality of ground engaging units such as 30, which in the illustrated embodiment are tracked ground engaging units 30. Each of the ground engaging units 30 is connected to the main frame 22 by a lifting column such as 32 which is attached to a swing arm such as 34. An operator's platform 36 is located on the main frame 22. A plow or spreader device 38 is supported from the main frame 22 ahead of the slip form paver mold 24. Also ahead of the mold 24 is an array of vibrators 25 which aid in consolidating the concrete material to be formed. Behind the slip form paver mold 24 a dowel bar inserter apparatus 40 may be provided. Behind the dowel bar inserter apparatus 40 an oscillating beam 41 and a super smoother apparatus 42 may be provided.

FIG. 4A shows a schematic cross-section of the newly formed concrete structure 16 taken along line 4-4 of FIG. 2. Assuming that the top surface 18 is horizontal, then ideally each lateral edge such as 46 of the concrete structure 16 is at the same elevation as the remainder of the top surface 18. But due to the physical nature of the newly formed concrete structure which is not yet hardened there may be some "slumping" of the concrete structure 16 near its edge, which is schematically illustrated in FIG. 4B. In FIG. 4B, due to the slumping, the elevation of the edge 46 has dropped by a distance 48. The practice in the prior art is to manually measure the distance 48 by placing a long straight edge 50 such as a two-by-four board on the top surface 18 so that it protrudes over the edge 46 and to measure the distance 48 with a ruler or tape measure. A typical engineering specification for permissible slump is that the distance 48 should be no greater than ⅜ inch (1 cm) if the edge 46 is to be a free edge of the finished structure. If the edge 46 is to be joined by another slab to be poured adjacent to the structure 16 then the distance 48 may be limited to no greater than ¼ inch (6 mm). These specifications may vary depending on the requirements of the particular structure 16 being created. These specifications may also vary depending on the national standards applicable in the country of use.

Also, in the field of airport runway paving the smoothness requirements are even greater because for airport paving both longitudinal smoothness and transverse smoothness are required. For that reason, many countries still prescribe the use of fixed paving forms, as opposed to slip form paving, for airport work.

The problem of slumping is dependent on many factors. The "wetness" of the concrete mixture being slip formed is an important factor, as is the speed with which the structure 16 is being formed. Wetter concrete mixture is more prone to slump. The faster the slip form paving machine is moving to form the structure 16, the more likely the finished structure is to slump. Another factor is the distance behind the slip form mold 24 for which the side walls 20 of the structure 16 are supported by a physical support such as the trailing side forms 44. The longer a distance the newly formed structure 16 is supported by the trailing side forms 44, the less slumping will occur when the trailing slip forms 44 move past the formed structure 16. Other factors include the adequacy of the vibration of the concrete by the vibrators 25.

Prior art slip form pavers have included a manually adjustable mold bottom plate which allows the structure 16 to be initially formed with an excess of concrete material in a lateral edge portion of the structure 16 to offset the anticipated slumping of the concrete. FIGS. 5-7 illustrate such a prior art mechanism that has previously been used by the assignee of the present invention.

FIG. 5 is a rear perspective view of the left end portion of the slip form mold 24. Mold 24 includes a mold frame 52 which is structurally attached to the main frame 22 of the apparatus 10. The left side plate assembly 26 is seen, as is a left side guide panel 54 which aids in guiding the unformed concrete material into the mold 24. The mold 24 includes a mold bottom plate 56 which forms the top surface 18 of the concrete structure 16. The bottom plate 56 is designed such that it has a small area 58 (encircled in FIG. 5) which is more flexible than the remainder of the bottom plate. This relatively flexible area 58 is created by providing stiffening gussets 60 and 62 on other portions of the bottom plate 56, but not in the area 58. The relatively flexible area 58 divides the bottom plate 56 into a lateral edge portion 56*a* (FIG. 7) of the bottom plate 56 and an interior portion 56*b* (FIG. 7) of the bottom plate 56.

Mounted within the mold frame 52 is an actuator assembly 63 including an actuator shaft 64 which is rotatable about its longitudinal axis. An actuator input arm 66 extends radially from the shaft 64. A conventional "dumb" hydraulic cylinder 68 has one end 70 connected to the mold frame 52 and another end 72 connected to an outer end of the actuator input arm 66. A series of shorter actuator output arms 74 are distributed along the length of the shaft 64. Each actuator output arm 74 is connected by an actuator link 76 to one of the stiffening gussets 60 at a pivot connection 77 near the laterally outer edge 78 of the bottom plate 56. In other prior art systems one or more hydraulic cylinders have been directly linked to the lateral edge portion 56*a* without having the shaft 64 and other associated components between the actuator and the lateral edge portion 56*a*.

The laterally outer edge 78 of the bottom plate 56 is free to move vertically relative to the side form assembly 26. FIGS. 5 and 6 show the lateral edge portion 56*a* of the bottom plate 56 aligned with the interior portion 56*b* of the bottom plate 56 so that there is no slump correction. In FIG. 7 the hydraulic actuator 68 has been extended to slightly rotate shaft 64 clockwise to pull up on the links 76 and lift the lateral edge portion 56*a* and rotate the lateral edge portion 56*a* about an axis generally in the center of the flexible area 58. When adjusted as shown in FIG. 7 the mold 24 will form a structure 16 immediately exiting the mold 24 that has a raised edge 46. Then after the structure 16 slumps the height of the edge 46 is manually checked as seen in FIG. 4B, and the manual adjustment and measurement process is repeated until the slumping is properly adjusted. This process of checking and adjusting continues during the paving operation because factors such as paving speed and the wetness of concrete delivered to the paving site may vary over time.

There is a continuing need for improvement of these processes.

SUMMARY OF THE INVENTION

In a first embodiment a slip form paver apparatus is configured to move in a paving direction across a ground surface for forming concrete into a newly formed concrete structure. The apparatus includes a main frame and a slip form paver mold supported by the main frame. The slip form paver mold includes a mold bottom plate configured to form a top surface of the newly formed concrete structure, the mold bottom plate including an interior portion and a lateral edge portion, the lateral edge portion being deflectable up and down relative to the interior portion. The mold further includes at least one side form assembly configured to close the slip form paver mold on at least one lateral side adjacent the lateral edge portion of the mold bottom plate and an actuator assembly connected to the lateral edge portion of the mold bottom plate for deflecting the lateral edge portion of the mold bottom plate up and down relative to the interior portion of the mold bottom plate. At least one edge height sensor is configured to generate an edge height signal corresponding to a height of an edge of the newly formed concrete structure and to thereby detect a slumping of the edge of the newly formed concrete structure behind the slip form paver mold. A controller is communicatively coupled to the at least one edge height sensor and to the actuator assembly. The controller is configured to receive the edge height signal, determine whether any slumping of the edge of the newly formed concrete structure exceeds a set slump limit, and to automatically control the actuator assembly at least in part in response to the edge height signal to adjust the height of the lateral edge portion of the mold bottom plate relative to the interior portion of the mold bottom plate and thereby adjust the height of the edge of the newly formed concrete structure so that any slumping of the edge of the newly formed concrete structure is within the set slump limit.

The at least one edge height sensor may be configured to detect a change in height of the edge of the newly formed concrete structure relative to the main frame or relative to any other part of the slip form paver apparatus having a constant height relative to the main frame.

The at least one edge height sensor may be configured to detect a difference in the height of the edge of the newly formed concrete structure relative to a height of an interior portion of the newly formed concrete structure.

The at least one edge height sensor may include an array of sensors extending transversely to the paving direction.

The array of sensors may extend substantially perpendicular to the paving direction.

The at least one edge height sensor may include a scanning sensor configured to scan in a scanning direction extending transversely to the paving direction.

The scanning sensor may be oriented to scan substantially perpendicular to the paving direction.

The slip form paving apparatus may include at least one trailing side plate trailing behind the at least one side form assembly, wherein the at least one edge height sensor is located behind the at least one trailing side plate.

The slip form paving apparatus may include an actuator assembly position sensor configured to detect a position of the actuator assembly.

The controller may be configured to: upon determining that the slumping exceeds the set slump limit, raise the height of the lateral edge portion of the mold bottom plate relative to the interior portion of the mold bottom plate a first incremental amount; after a predetermined time interval has passed, or after the slip form paver apparatus has traveled a predetermined distance, after the raising of the height of the lateral edge portion of the mold bottom plate by the first incremental amount, again determine whether the slumping of the edge of the newly formed concrete structure exceeds the set slump limit; and if the slumping is determined to still exceed the set slump limit, raise the height of the lateral edge portion of the mold bottom plate relative to the interior portion of the mold bottom plate a further incremental amount.

The predetermined time interval may be a time at least sufficient for the slip form paver apparatus to travel a distance equal to a distance of the at least one edge height sensor behind the slip form paver mold.

The actuator assembly may include a smart hydraulic cylinder including an integral extension sensor for detecting an extension value of the smart hydraulic cylinder, the integrated extension sensor being the actuator assembly position sensor.

The actuator assembly position sensor may also be included in any form of smart linear actuator or smart rotary actuator. Further a "dumb" actuator may be used and the actuator position sensor may be separate from the actuator.

The controller may be configured to: determine based at least in part on the edge height signal a needed change in height of the lateral edge portion of the mold bottom plate relative to the interior portion of the mold bottom plate necessary to correct the slumping of the edge of the newly formed concrete structure behind the slip form paver mold; and direct the actuator assembly to effect a change in actuator assembly position corresponding to the needed change in height of the lateral edge portion of the mold bottom plate relative to the interior portion of the mold bottom plate.

The controller may further be configured to send a warning to an operator of the slip form paver apparatus in an event where slumping of the edge of the newly formed concrete structure is still in excess of the set slump limit after adjustment of the height of the lateral edge portion of the mold bottom plate relative to the interior portion of the mold bottom plate to or beyond a predetermined limit.

The controller may further be configured, in an event where slumping of the edge of the newly formed concrete structure is still in excess of the set slump limit after adjustment of the height of the lateral edge portion of the mold bottom plate to or beyond a predetermined limit, to reduce vibrational frequency of one or more of the vibrators of an array of vibrators in front of the slip form mold.

In another embodiment a method of operating a slip form paving apparatus may include: monitoring a height of a lateral edge of a newly formed concrete structure formed by the slip form paver apparatus with at least one edge height sensor; automatically determining with a controller whether any slumping of the lateral edge of the newly formed concrete structure exceeds a set slump limit; and automatically adjusting with the controller a height of a lateral edge portion of a mold bottom plate of the slip form paver apparatus relative to an interior portion of the mold bottom plate if any slumping of the lateral edge of the newly formed concrete structure exceeds the set slump limit and thereby adjusting the height of the lateral edge of the newly formed concrete structure so that any slumping of the edge of the newly formed concrete structure is within the set slump limit.

The monitoring step may further include detecting a change in height of the lateral edge of the newly formed concrete structure relative to a main frame of the slip form paver apparatus or relative to any part of the slip form apparatus supported in a constant position relative to the main frame.

The monitoring step may further include detecting a difference in height of the lateral edge of the newly formed concrete structure relative to an interior portion of the newly formed concrete structure.

The automatically adjusting step may include adjusting an actuator assembly connected to the lateral edge portion of the mold bottom plate.

The automatically adjusting step may include detecting a position of the actuator assembly with an actuator assembly position sensor.

The automatically adjusting step may include: upon determining that the slumping exceeds the set slump limit, raising the height of the lateral edge portion of the mold bottom plate relative to the interior portion of the mold bottom plate a first incremental amount; after a predetermined time interval has passed, or after the slip form paver apparatus has traveled a predetermined distance, after the raising of the height of the lateral edge portion of the mold bottom plate by the first incremental amount, again determining whether the slumping of the edge of the newly formed concrete structure exceeds the set slump limit; and if the slumping is determined to still exceed the set slump limit, raising the height of the lateral edge portion of the mold bottom plate relative to the interior portion of the mold bottom plate a further incremental amount.

In the above method the predetermined time interval may be a time at least sufficient for the slip form paver apparatus to travel a distance equal to a distance of the at least one edge height sensor behind the mold bottom plate.

In another embodiment the automatically adjusting step may include: determining based at least in part on an edge height signal from the at least one edge height sensor a needed change in height of the lateral edge portion of the mold bottom plate relative to the interior portion of the mold bottom plate necessary to correct the slumping of the edge of the newly formed concrete structure; and directing an actuator assembly to effect a change in actuator assembly position corresponding to the needed change in height of the lateral edge portion of the mold bottom plate relative to the interior portion of the mold bottom plate.

The method may further include automatically sending a warning to an operator of the slip form paver apparatus in an event where slumping of the edge of the newly formed concrete structure is still in excess of the set slump limit after adjustment of the height of the lateral edge portion of the mold bottom plate relative to the interior portion of the mold bottom plate beyond a predetermined limit.

The method may further include automatically reducing a vibrational frequency of one or more vibrators of the slip form paver apparatus in front of the slip form mold to reduce an energy input by the one or more vibrators adjacent a laterally outer edge of the slip form mold, in an event where slumping of the edge of the newly formed concrete structure is still in excess of the set slump limit after adjustment of the height of the lateral edge portion of the mold bottom plate to or beyond a predetermined limit.

Numerous objects, features and advantages of the embodiments set forth herein will be readily apparent to those skilled in the art upon reading of the following disclosure when taken in conjunction with the accompanying drawings.

DETAILED DESCRIPTION

Figure 7:
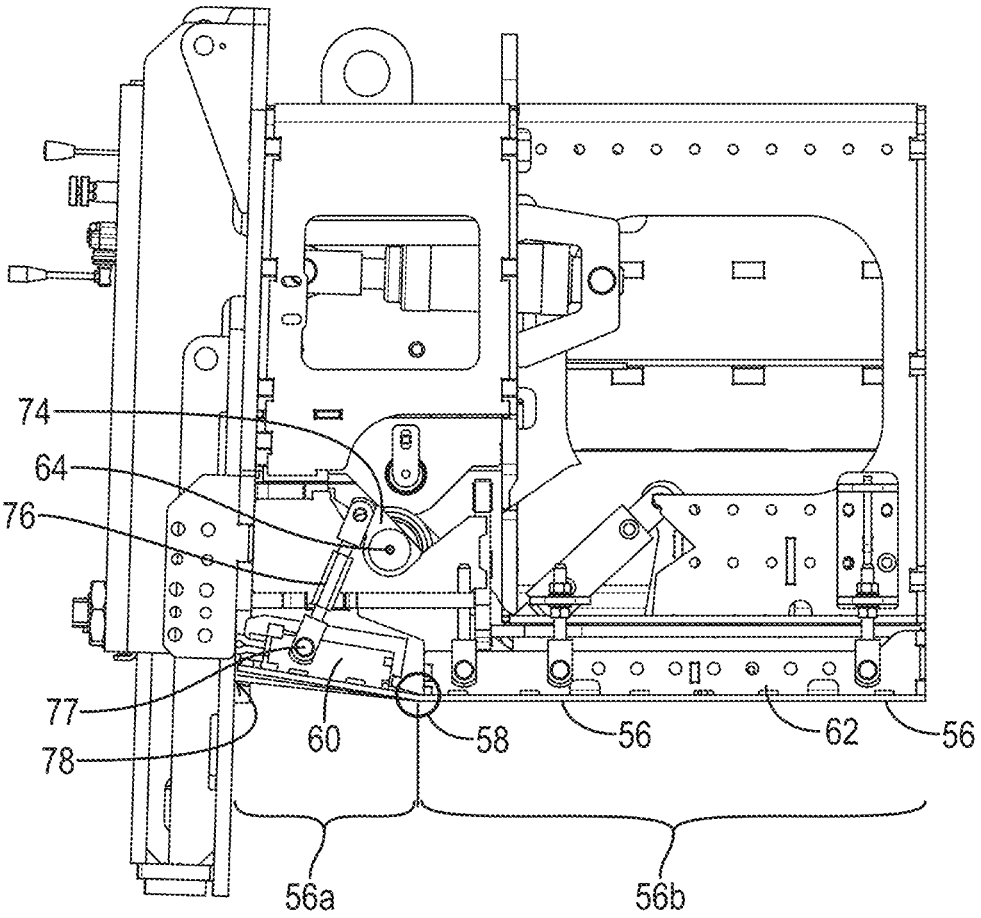
FIG. 7 (PRIOR ART)
FIG. 7 is a rear elevation view similar to FIG. 6, but with the lateral edge portion of the mold bottom plate at a height higher than the height of the interior portion of the mold bottom plate so as to raise a resulting edge height of the finished concrete structure as compared to the edge height that would be created by the arrangement of FIG. 6.
Figure 8:
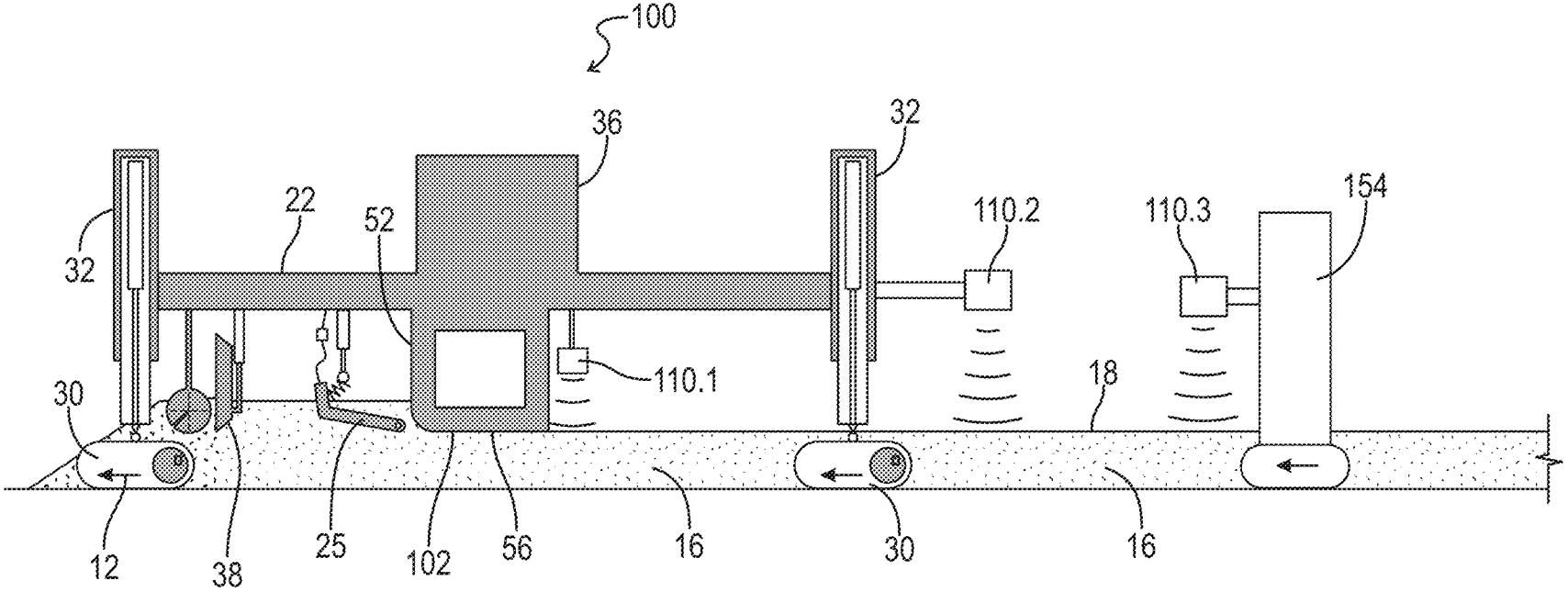
FIG. 8 is a schematic side elevation view of a slip form paver apparatus incorporating the present invention.

FIG. 8 is a schematic side elevation view of a slip form paver apparatus 100 of the present invention. Those components of the slip form paver apparatus 100 which are substantially the same as the corresponding components of the prior art apparatus of FIGS. 1-7 carry the same part numbers as used in FIGS. 1-7 and will not be further described.

The slip form paver apparatus 100 eliminates the laborious manual setup, manual slump measurement and manual adjustment processes described above with regard to FIGS. 1-7. A sensor system is provided which is capable of automatically detecting and measuring edge slump of the finished concrete structure, along with a controller configured to automatically adjust the deflection of the lateral edge portion 56*a* of the mold bottom plate 56 to correct for any detected slumping.

Figure 1:
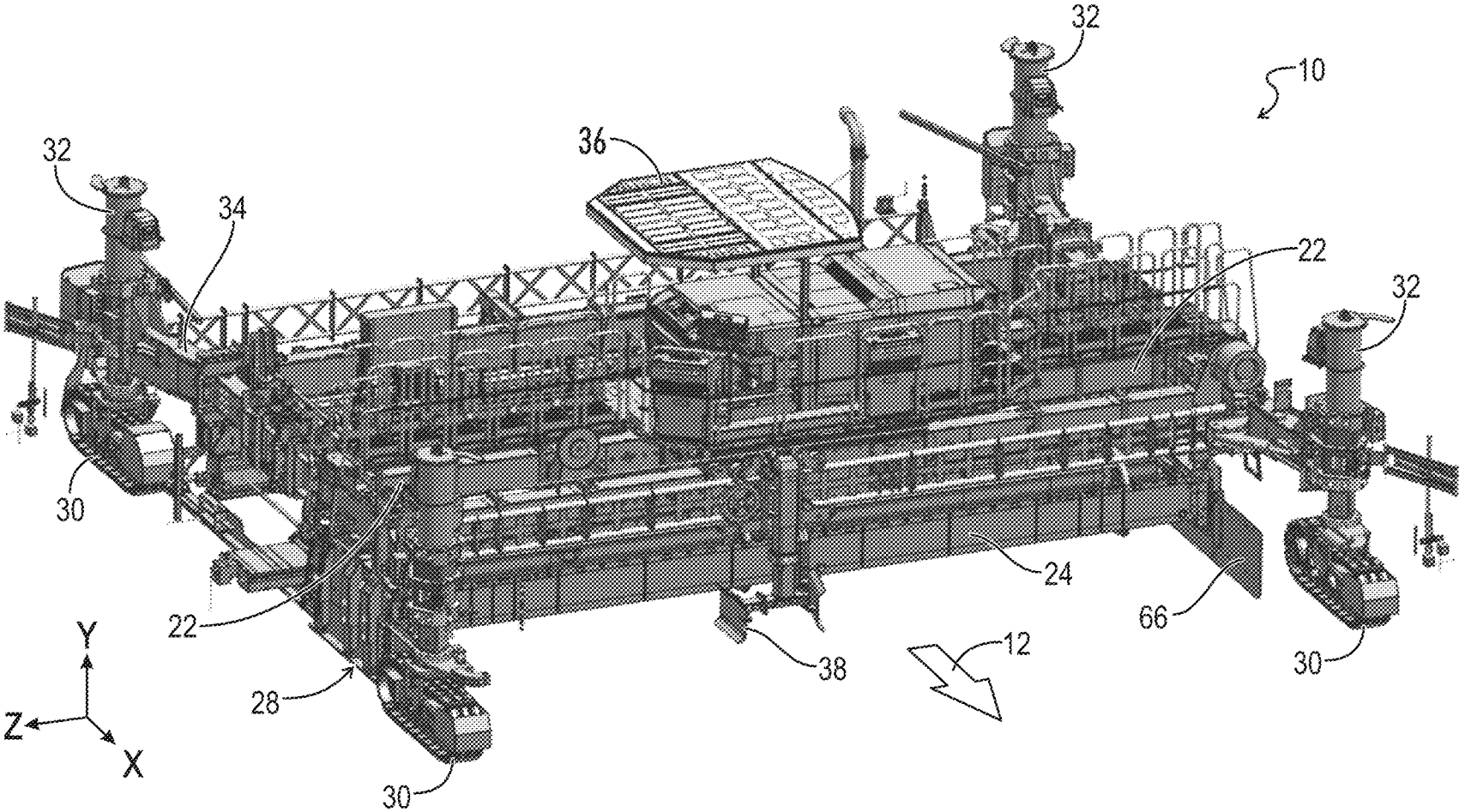
FIG. 1 (PRIOR ART)
FIG. 1 is a right side front perspective view of an inset type of slip form paver apparatus of the prior art. It is noted that the terms left and right are used herein from the perspective of an operator driving the slip form paver apparatus and facing forward in the paving direction.
Figure 2:
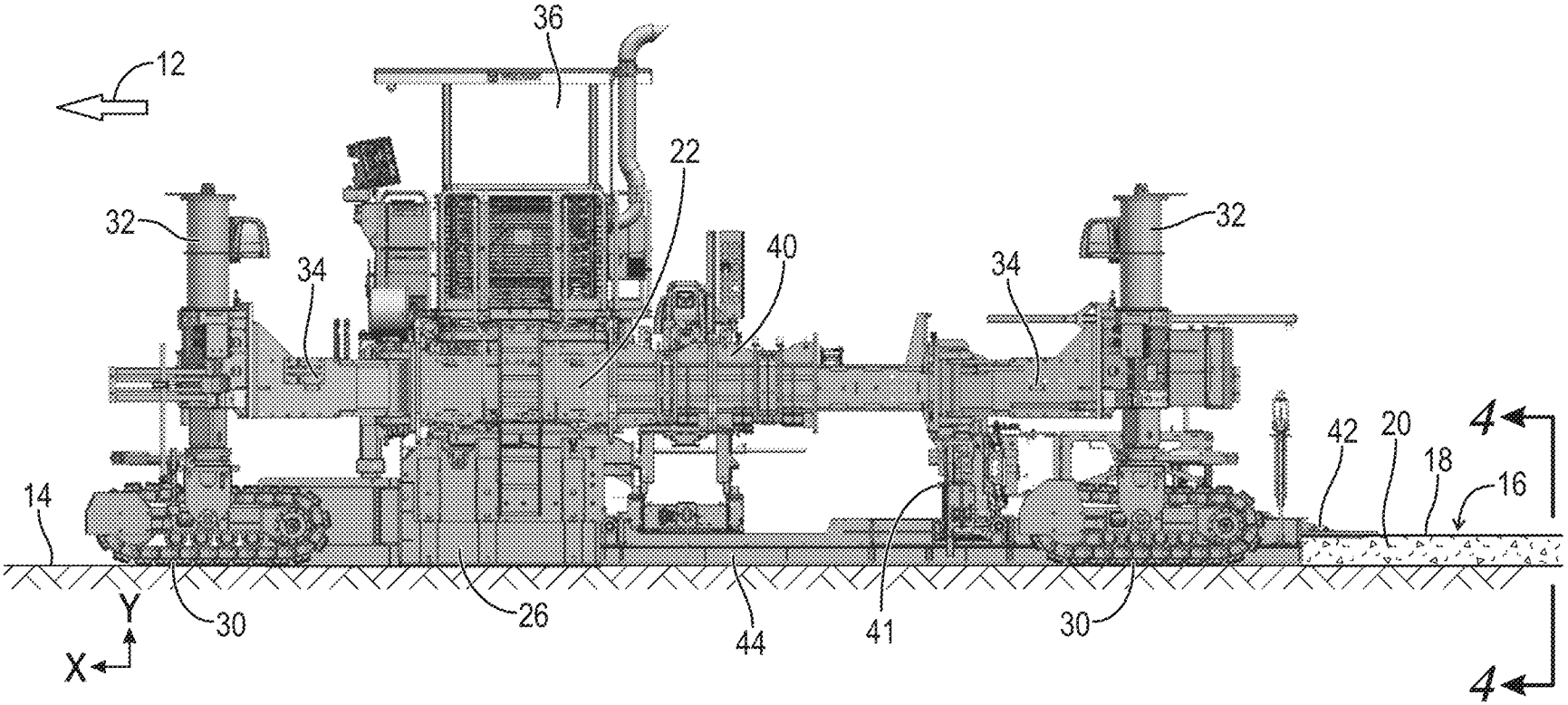
FIG. 2 (PRIOR ART)
FIG. 2 is a left side elevation view of the prior art slip form paver apparatus of FIG. 1.
Figure 3:
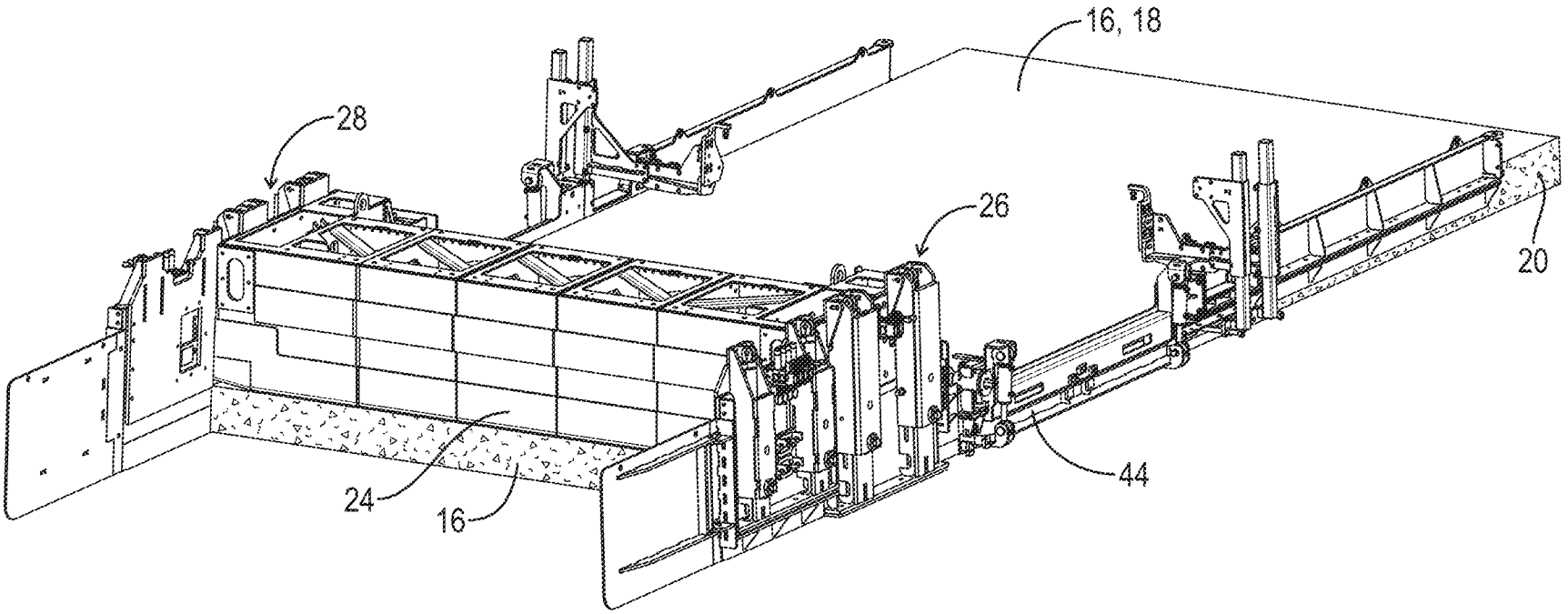
FIG. 3 (PRIOR ART)
FIG. 3 is a left side front perspective view of the prior art slip form paver mold of FIGS. 1 and 2, and left and right side form assemblies including multiple trailing side forms.
Figure 4A:
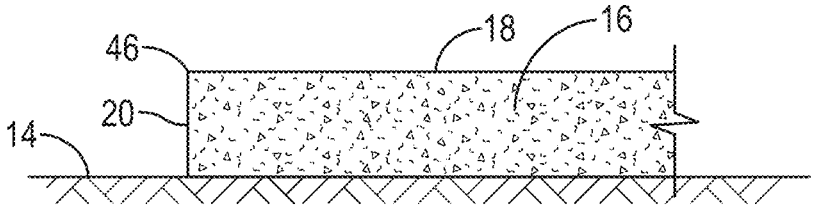
FIG. 4A (PRIOR ART)
FIG. 4A is a schematic section view of an ideal newly formed concrete structure of the prior art showing one edge portion of the finished concrete structure and an interior portion of the newly formed concrete structure.
Figure 4B:
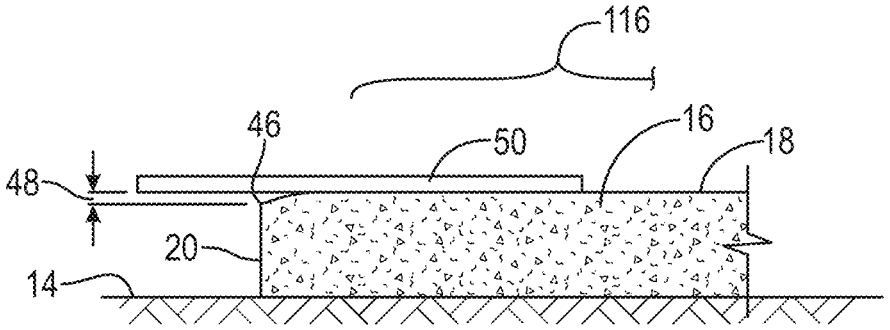
FIG. 4B (PRIOR ART)
FIG. 4B illustrates the prior art technique for manually measuring the slump of the edge of the newly formed concrete structure.
Figure 5:
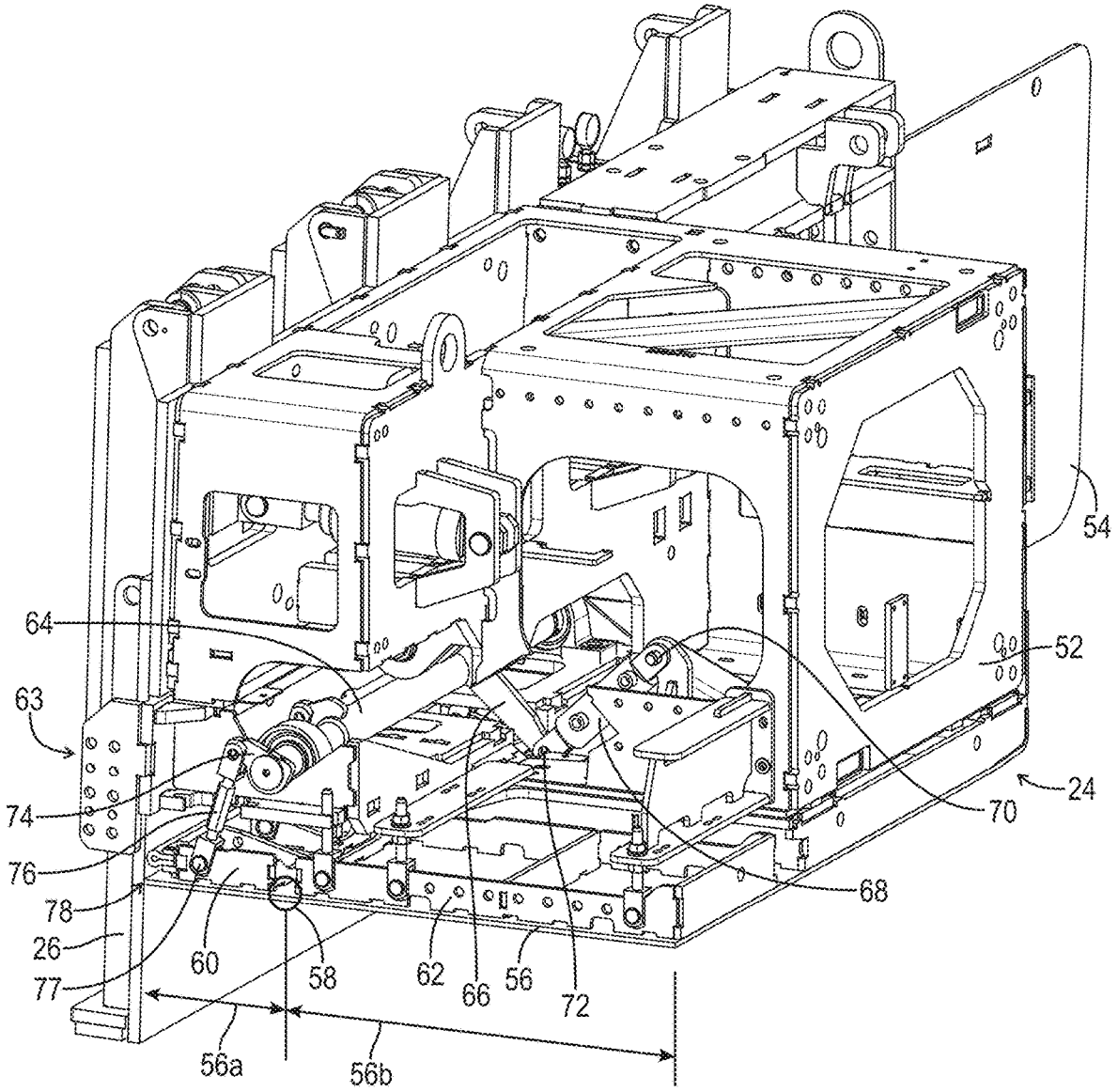
FIG. 5 (PRIOR ART)
FIG. 5 is a rear perspective view of a left hand part of the prior art concrete mold showing an actuator assembly for adjusting a height of the lateral edge portion of the mold bottom plate relative to the interior portion of the mold bottom plate.
Figure 6:
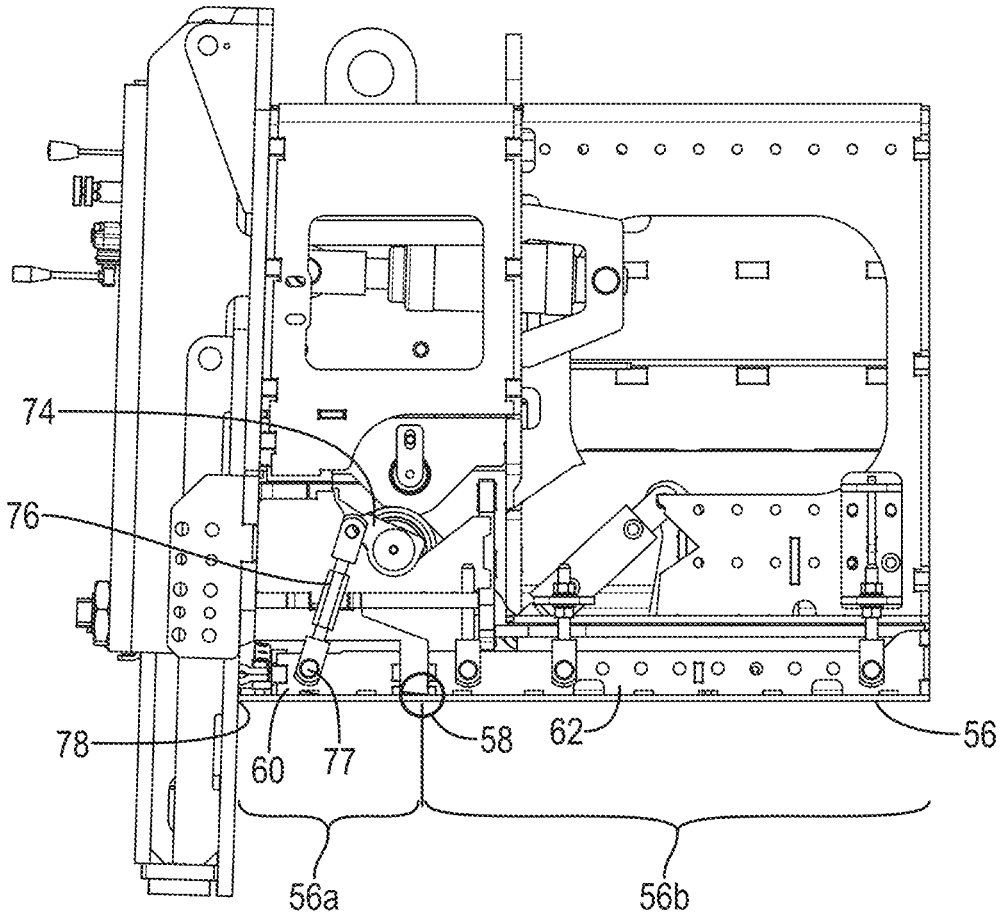
FIG. 6 (PRIOR ART)
FIG. 6 is a rear elevation view of the prior art structure seen in FIG. 5, with the lateral edge portion of the mold bottom plate at a height level with a height of the interior portion of the mold bottom plate.

The slip form paver apparatus 100 includes a main frame 22 and a slip form paver mold 102 supported from the main frame 22. The mold 102 includes a mold frame 52, a mold bottom plate 56 and side form assemblies 24 and 26 substantially as shown in FIGS. 5-7.

Figure 13:
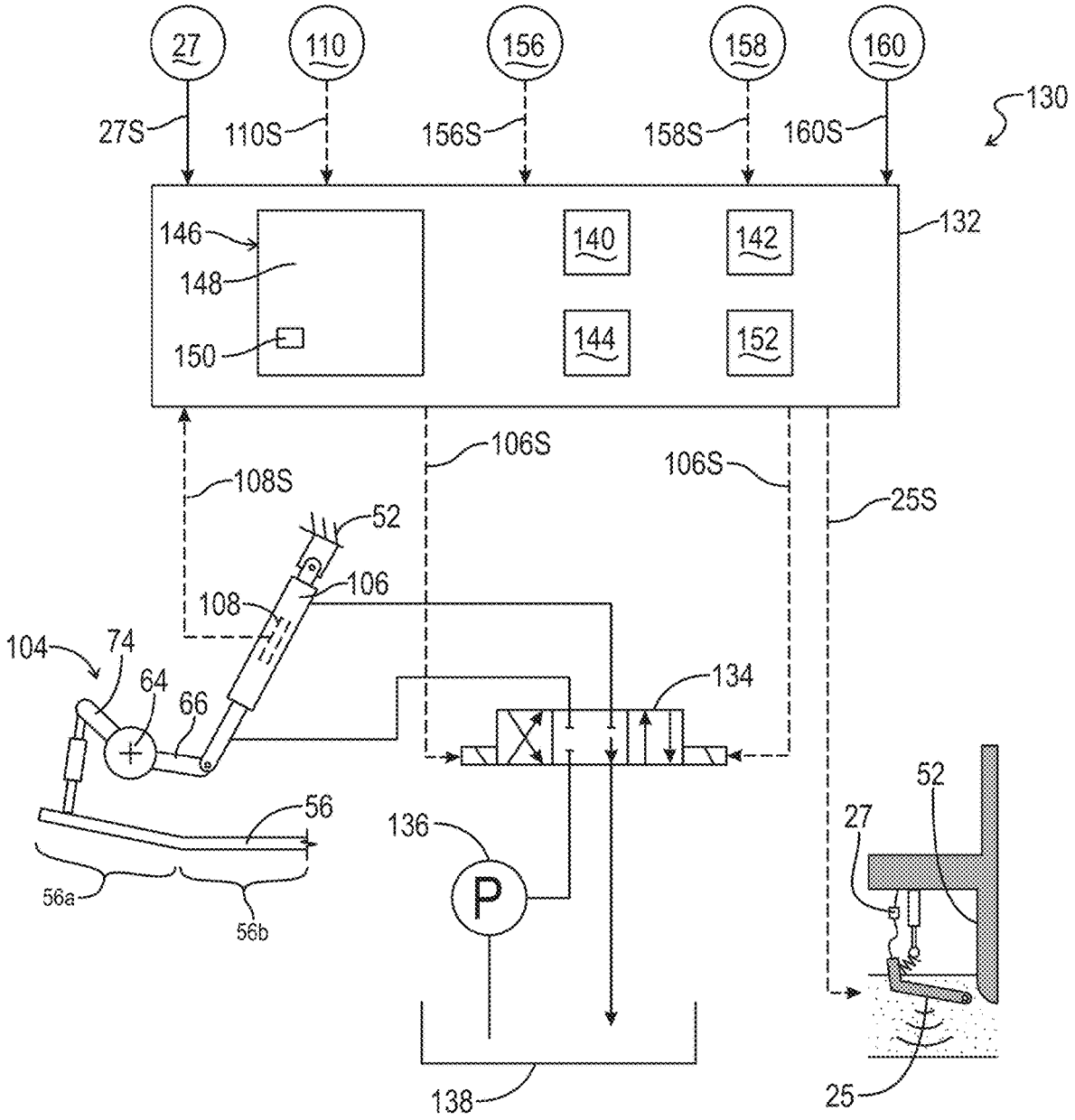
FIG. 13 is a schematic drawing of a controller system of the paving machine of FIG. 8.

The mold 102 includes a modified actuator assembly 104 as schematically shown in FIG. 13. The actuator assembly 104 includes the actuator shaft 64, actuator input arm 66, actuator output arm 74 and link 76 substantially as described above regarding FIGS. 5-7. A "smart" hydraulic cylinder actuator 106 is connected between the mold frame 52 and the actuator input arm 66 in place of the "dumb" hydraulic cylinder 68 of the prior art. Smart hydraulic cylinder actuator 106 includes an integrated extension sensor 108 which generates a position signal 108S indicative of an extension position of the smart hydraulic cylinder actuator 106 and thus indicative of the position of the various links in the actuator assembly 104 and of the position of the lateral edge portion 56*a* of mold bottom plate 56 relative to the interior portion 56*b*.

The integrated extension sensor 108 may be referred to as an actuator assembly position sensor 108 configured to detect a position of the actuator assembly 104. Other embodiments of an actuator assembly position sensor 108, other than an integrated extension sensor of a smart hydraulic cylinder may be used. For example, an actuator assembly position sensor in the form of a rotary position sensor on the actuator shaft 64 could provide similar position information representative of the position of the entire actuator assembly 104 and of the lateral edge portion 56*a* of the mold bottom plate 56. When using such a rotary position sensor the smart hydraulic cylinder actuator 106 could be replaced by a conventional dumb hydraulic cylinder which does not include an integrated extension sensor.

Figure 17:
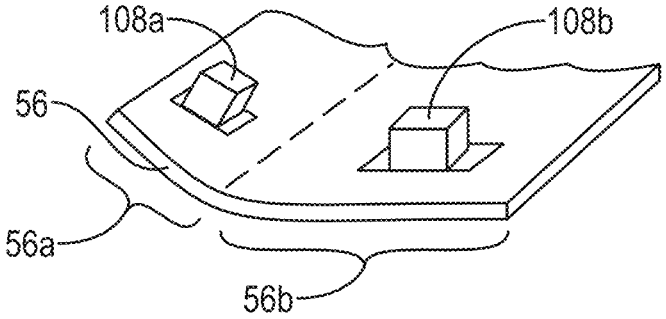
FIG. 17 is a schematic drawing of an alternative actuator assembly position sensor arrangement including inclination sensors placed upon the bottom plate of the slip form mold.

Alternatively, the actuator assembly position sensor 108 may be mounted on the lateral edge portion 56*a* and directly measure a position of the lateral edge portion 56*a* relative to the interior portion 56*b*, which will correspond to the position of the actuator assembly 104. For example, as schematically shown in FIG. 17, the actuator assembly position sensor 108 may include a first inclination sensor 108*a* mounted on the lateral edge portion 56*a* and a second inclination sensor 108*b* mounted on the interior portion 56*b* of bottom plate 56. Alternatively the second inclination sensor 108*b* could be mounted on the machine frame 22 or any other component that is fixed relative to the machine frame 22. By a comparison of the inclination signals from sensors 108*a* and 108*b* the controller 132 may determine the angle of the lateral edge portion 56*a* relative to the interior portion 56*b*, and then from the known geometry of the bottom plate 56 the controller 132 may determine the position of the lateral edge portion 56*a* and thus the position of the actuator assembly 104.

Figure 18:
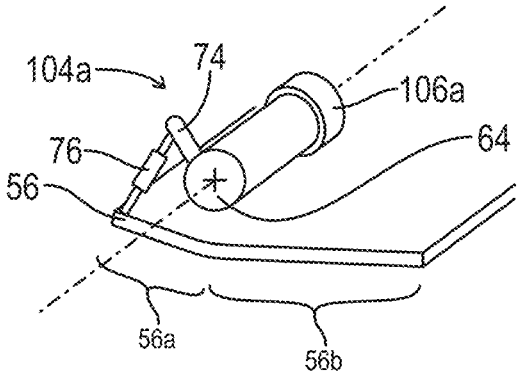
FIG. 18 is a schematic drawing of an alternative actuator assembly using a rotary actuator.

An alternative embodiment of the actuator assembly 104 is schematically illustrated in FIG. 18 as 104*a*. The actuator assembly 104*a* replaces the hydraulic smart cylinder actuator 106 with a rotary actuator 106*a* directly driving the shaft 64.

Figure 19:
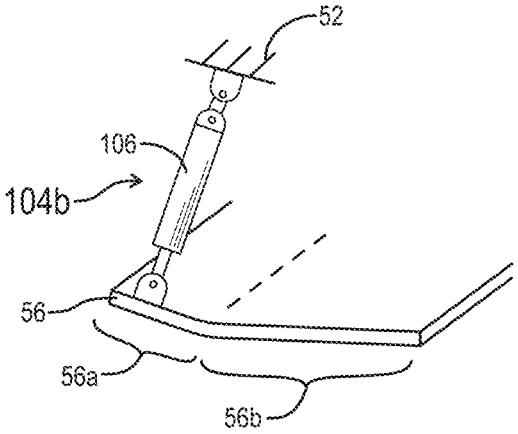
FIG. 19 is a schematic drawing of an alternative actuator assembly using hydraulic cylinder actuators directly connected to the lateral edge portion of the mold bottom plate.

A further alternative embodiment of the actuator assembly 104 is schematically shown in FIG. 19 as 104*b*. The actuator assembly 104*b* includes one or more hydraulic smart cylinders 106 directly connected between the lateral edge portion 56*a* and the mold frame 52.

The slip form paver apparatus 100 further includes at least one edge height sensor 110 configured to generate an edge height signal 110S corresponding to the height of the edge 46 of the newly formed concrete structure 16, and to thereby detect a slumping of the edge 46 of the newly formed concrete structure 16 behind the slip form paver mold 102.

Figure 9:
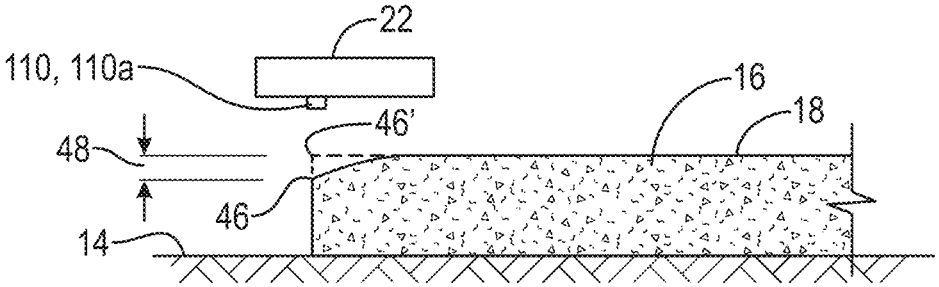
FIG. 9 is a schematic rear elevation view of an edge height sensor including a single non-contact sensor focused on the edge of the newly formed concrete structure.

As schematically shown in FIG. 9, in the broadest sense the at least one edge height sensor could be a single non-contact sensor 110*a* directed toward the edge 46 and supported from the machine frame 22, or some other component which is held at a fixable height relative to the machine frame 22, such as the slip form mold 24. The sensor 110*a* could alternatively be supported from the side form 26, the oscillating beam 41 or the super smoother 42. Such sensor 110*a* may be calibrated for a reading representing a perfect non-slumping edge 46 and then changes from that calibrated value may be detected. The sensor 110*a* may be an ultrasonic sensor, an infrared sensor, a laser sensor, or any other suitable non-contact sensing device.

Figure 10:
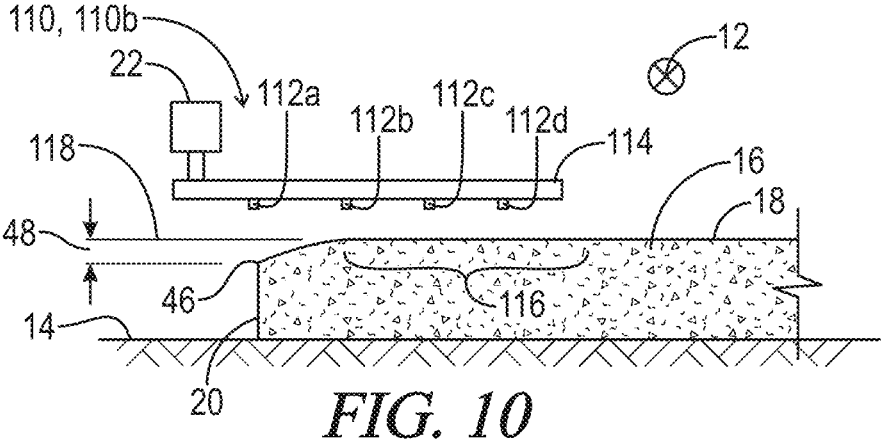
FIG. 10 is a schematic rear elevation view of an edge height sensor including an array of sensors extending transversely to the paving direction.
Figure 11:
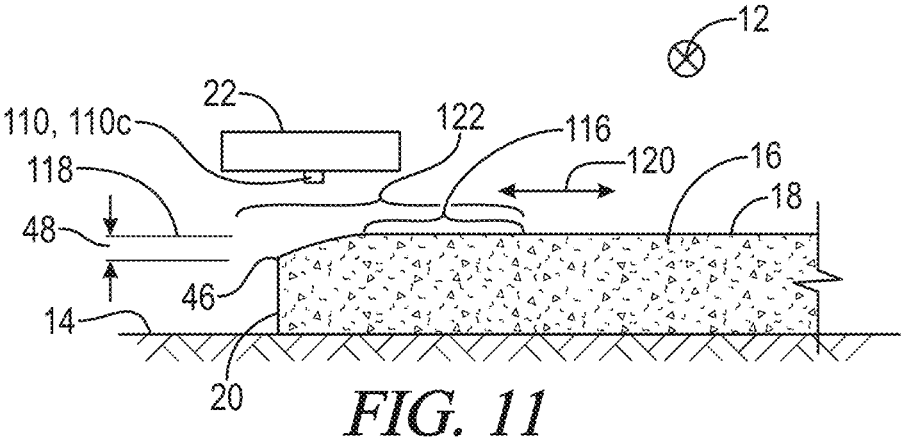
FIG. 11 is a schematic rear elevation view of an edge height sensor including a scanning sensor configured to scan in a scanning direction extending transversely to the paving direction.

FIGS. 10 and 11 schematically illustrate two further embodiments of a height sensor 110.

FIG. 10 schematically illustrates the edge height sensor 110 in an embodiment 110*b* including an array 112 of individual sensor elements such as 112*a*, 112*b*, 112*c*, etc., arranged along the length of a sensor support 114 extending transversely to the paving direction 12. In FIG. 10 the paving direction 12 is normal to the plane of the drawing and extends into the drawing plane. Preferably the array 112 extends substantially parallel to a rear edge 164 (see FIG. 12) of the slip form mold 24, which may also be described as substantially perpendicular to the paving direction 12.

Preferably the array of sensor elements 112 includes at least two of the individual sensor elements arranged over an interior portion 116 of the concrete structure 16 far enough away from the edge 46 such that any slumping of the edge 46 does not affect the top surface 18 along the interior portion 116. This allows the height readings from the sensor elements 112*b*, 112*c*, 112*d* over the interior portion 116 to be utilized to determine a line 118 defining the profile of the top surface 18 and projecting over the edge 46. Then the data from the sensor element 112*a* over the edge 46 can be used to determine a relative distance to the edge 46. Based on known dimensions of the array 112 and the transverse distance between the array elements 112*a*, 112*b*, etc. the distance 48 that the edge 46 has slumped below the projected line 118 can be calculated. The sensor elements 112 *a*, 112*b*, etc. may be ultrasonic sensors, infrared sensors, laser sensors, or any other suitable non-contact sensing device.

Similarly, as schematically shown in FIG. 11 the edge height sensor 110 can be in the form of a scanning sensor 110*c* configured to scan the top profile of the concrete structure 16 in a scanning direction 120 transverse to the paving direction 12. Preferably the scanning direction 120 extends substantially perpendicular to the paving direction 12. The scanning sensor 110*c* should be configured to scan across a portion 122 of the concrete structure extending well into the interior portion 116. The scanning sensor 110*b* may for example be a laser scanner, an infrared scanner, an imaging camera, or any other suitable scanning sensor technology.

Thus, either of the sensors 110*b* or 110*c* is configured to detect a difference 48 in the height of the edge 46 of the finished concrete structure relative to a height of the interior portion 116 of the finished concrete structure 16.

Figure 20:
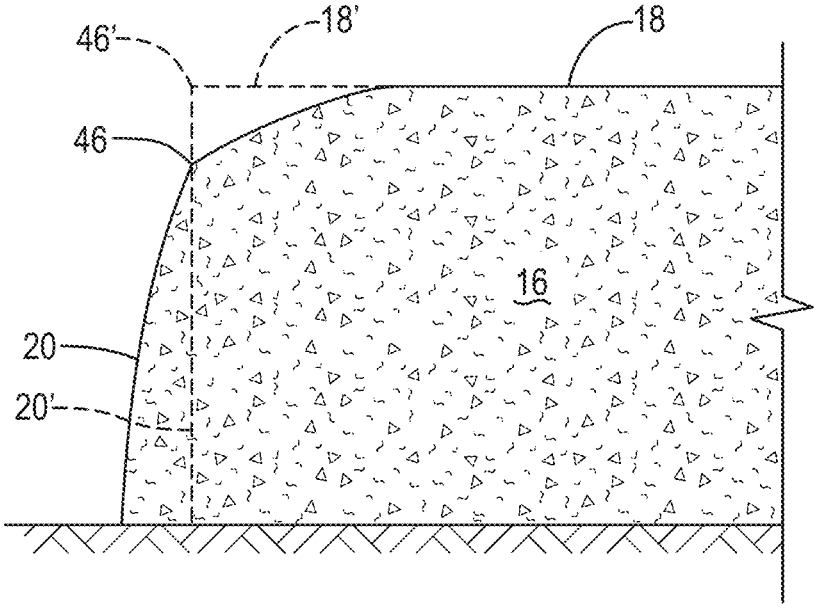
FIG. 20 is an enlarged schematic cross-section view of a newly formed concrete slab illustrating the edge slumping phenomena.

It will be appreciated that the drawings illustrating edge slump in FIGS. 4B and 9-12 discussed above are simplified schematic drawings, and an actual slumping concrete slab may not have so distinct of an edge 46 as illustrated. This is because the slumping will typically also involve some lateral slumping of the lateral concrete side 20 of the slab 18 so that the edge 46 will be blurred or rounded. A more realistic drawing of a slumping concrete slab is shown in FIG. 20. The ideal non-slumping slab profile is shown in dashed lines with the top surface indicated as 18', the lateral side indicated as 20' and the edge indicated as 46'. The actually slumped profile is shown in solid lines with the edge 46 being somewhat rounded and with the lateral side 20 slumping laterally outward from the desired profile 20'. The various embodiments of the edge height sensor 110 discussed above need not be directed exactly at the location of the desired edge 46' or the actual edge 46 but may be directed at adjacent portions of the slab. So long as the edge height sensor 110 is observing slab deformation due to slumping adjacent the edge 46 the resulting edge height signal may be said to correspond to the height of the edge of the newly formed concrete structure. For example, the edge height sensor might look at the slab a short distance laterally inward of the ideal location of the edge 46.

And with the multiple sensor embodiment of FIG. 10 or the scanning sensor embodiment of FIG. 11 the sensor may gather data about slumping of the top surface 18 of the slab at multiple locations laterally inward from the side wall 20 and the controller may evaluate slumping at those multiple locations. All of this data may be described as an edge height signal corresponding to a height of the edge of the newly formed concrete structure and thereby detecting a slumping of the edge of the newly formed concrete structure.

It is noted that although FIGS. 10 and 11 illustrate the newly formed concrete structure 16 as having a horizontal top surface 18 on interior portion 116, the same techniques of measuring the distance 48 would apply to a crowned surface having a cross-slope transverse to the paving direction. In the case of a newly formed cross-sloped surface the projected line 118 would have a slope equal to the cross-slope of the top surface 18 of the interior portion 116 of the newly formed concrete structure 16.

Figure 12:
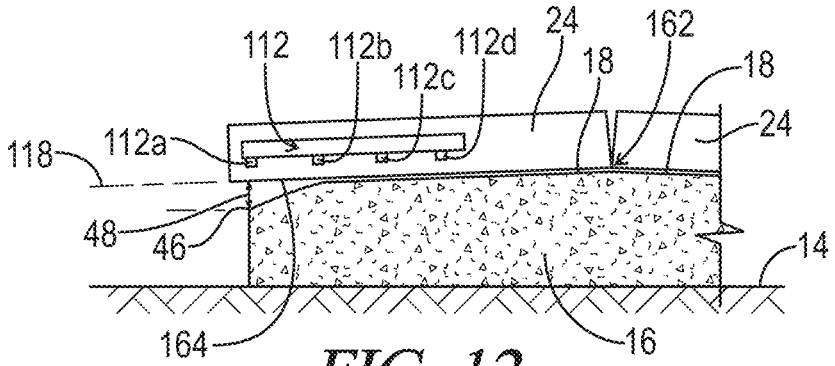
FIG. 12 is a schematic rear elevation view of an edge height sensor including an array of sensors like that of FIG. 10 mounted on the slip form paver mold and oriented parallel to a rear edge of the slip form paver mold so that the orientation of the sensor array is adjusted with any crown adjustment in the slip form paver mold.

FIG. 12 schematically shows an alternative embodiment for dealing with the issues presented by a crowned top surface 18 having a crown 162. This embodiment orients the sensors 110*b* or 110*c* so that the array 112 or a scan line of the scanning sensor 110*c* is oriented substantially parallel to a rear edge 164 of the bottom plate 56 of the slip form mold 24. This should include having the array 112 or scanning sensor 110*c* oriented at the same cross-slope as the rear edge 164 of the bottom plate 56 of the slip form mold 24 which forms the crowned surface 18. Such an arrangement is schematically illustrated in FIG. 12 for the array 112 and may be accomplished by mounting the array 112 on the slip form mold 24 so the array 112 extends parallel to the rear edge of the bottom plate 56. Then if the crown setting of the mold 24 is adjusted the orientation of the array 112 is adjusted with the mold.

FIG. 8 schematically illustrates several optional locations for the edge height sensors 110. A first possible location immediately behind the mold 102 is indicated as 110.1. A second location behind any trailing side plates such as 44 (see FIG. 3) is represented as 110.2 and such a sensor may be supported from a rear portion of the machine frame 22. It is also even possible that the edge height sensors 110 may be located on a separate vehicle such as for example in position 110.3 where the edge height sensors 110 are located on a texture-curing machine 154 following behind the slip form paving machine 100. In general the edge height sensors 110 should be located behind the location where the lateral side 20 of the newly formed concrete structure 16 ceases to be supported by a side plate assembly 26 or 28 or by a trailing side form 44. Further it may be desirable to locate the edge height sensors 110 a sufficient distance behind such support of the lateral side 20 to allow time for any "slumping" to occur. Also more than one edge height sensor 110 may be provided at more than one of the locations noted above.

The Control System:

As schematically illustrated in FIG. 13, the machine 100 includes a control system 130 including a controller 132. The controller 132 may be part of the machine control system of the slip form paver 100, or it may be a separate control module. The controller 132 may for example be mounted in a control panel located at the operator's station 36. Controller 132 is configured to receive input signals from the various sensors. The signals transmitted from the various sensors to the controller 132 are schematically indicated in FIG. 13 by lines connecting the sensors to the controller with an arrowhead indicating the flow of the signal from the sensor to the controller 132.

For example, extension signals 108S from the extension sensor 108 will be received by controller 132 so that the controller 132 can monitor and control the extension of the hydraulic smart cylinder 106 which drives the actuator assembly 104. Also edge height signals 110S will be received from edge height sensors 110 so the controller 132 can determine whether any slumping of the edge 46 of the finished concrete structure 16 exceeds a set slump limit.

Similarly, the controller 132 will generate control signals for controlling the operation of the various actuators discussed above, which control signals are indicated schematically in FIG. 13 by lines connecting the controller 202 to graphic depictions of the various actuators with the arrow indicating the flow of the command signal from the controller 202 to the respective actuators. It will be understood that for control of a hydraulic cylinder type actuator, such as the hydraulic smart cylinder 106, the controller 132 will send an electrical signal 106S to an electro/mechanical control valve 134 which controls flow of hydraulic fluid from pump 136 to the hydraulic cylinder 106 and from the hydraulic cylinder 106 back to a tank 138. As is further explained below the controller 132 may automatically control the hydraulic cylinder 106 at least in part in response to the edge height signal 110S to adjust the height of the lateral edge portion 56*a* of the mold bottom plate 56 relative to the interior portion 56*b* of the mold bottom plate 56 and thereby adjust the height of the edge 46 of the finished concrete structure 16.

Controller 132 includes or may be associated with a processor 140, a computer readable medium 142, a data base 144 and an input/output module or control panel 146 having a display 148. An input/output device 150, such as a keyboard, joystick or other user interface, is provided so that the human operator may input instructions to the controller. It is understood that the controller 132 described herein may be a single controller having all of the described functionality, or it may include multiple controllers wherein the described functionality is distributed among the multiple controllers.

Various operations, steps or algorithms as described in connection with the controller 132 can be embodied directly in hardware, in a computer program product 152 such as a software module executed by the processor 140, or in a combination of the two. The computer program product 152 can reside in RAM memory, flash memory, ROM memory, EPROM memory, EEPROM memory, registers, hard disk, a removable disk, or any other form of computer-readable medium 142 known in the art. An exemplary computer-readable medium 142 can be coupled to the processor 140 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The data storage in computer readable medium 142 and/or database 144 may in certain embodiments include a database service, cloud databases, or the like. In various embodiments, the computing network may comprise a cloud server, and may in some implementations be part of a cloud application wherein various functions as disclosed herein are distributed in nature between the computing network and other distributed computing devices. Any or all of the distributed computing devices may be implemented as at least one of an onboard vehicle controller, a server device, a desktop computer, a laptop computer, a smart phone, or any other electronic device capable of executing instructions. A processor (such as a microprocessor) of the devices may be a generic hardware processor, a special-purpose hardware processor, or a combination thereof.

Particularly the controller 132 may be programmed to receive extension signals 110S from the extension sensor 110 of the hydraulic smart cylinder 106 and to send control signals 106S to control the extension of the hydraulic smart cylinder 106 at least in part in response to the respective extension signals 110S.

The controller 132 may be configured through appropriate operational connection with the extension sensor 110 or other actuator position sensor and the hydraulic smart cylinder 106 or other actuator, and through appropriate programming via software instructions in the software 152 to: receive the edge height signals 110*s*; determine whether any slumping of the edge 46 of the newly formed concrete structure 16 exceeds the set slump limit; and automatically control the actuator assembly 104 at least in part in response to the edge height signal 110S to adjust the height of the lateral edge portion 56*a* of the mold bottom plate 56 relative to the interior portion 56*b* of the mold bottom plate 56 and thereby adjust the height of the edge 46 of the newly formed concrete structure 16 so that any slumping 48 of the edge of the newly formed concrete structure is within the set slump limit.

Figure 14:
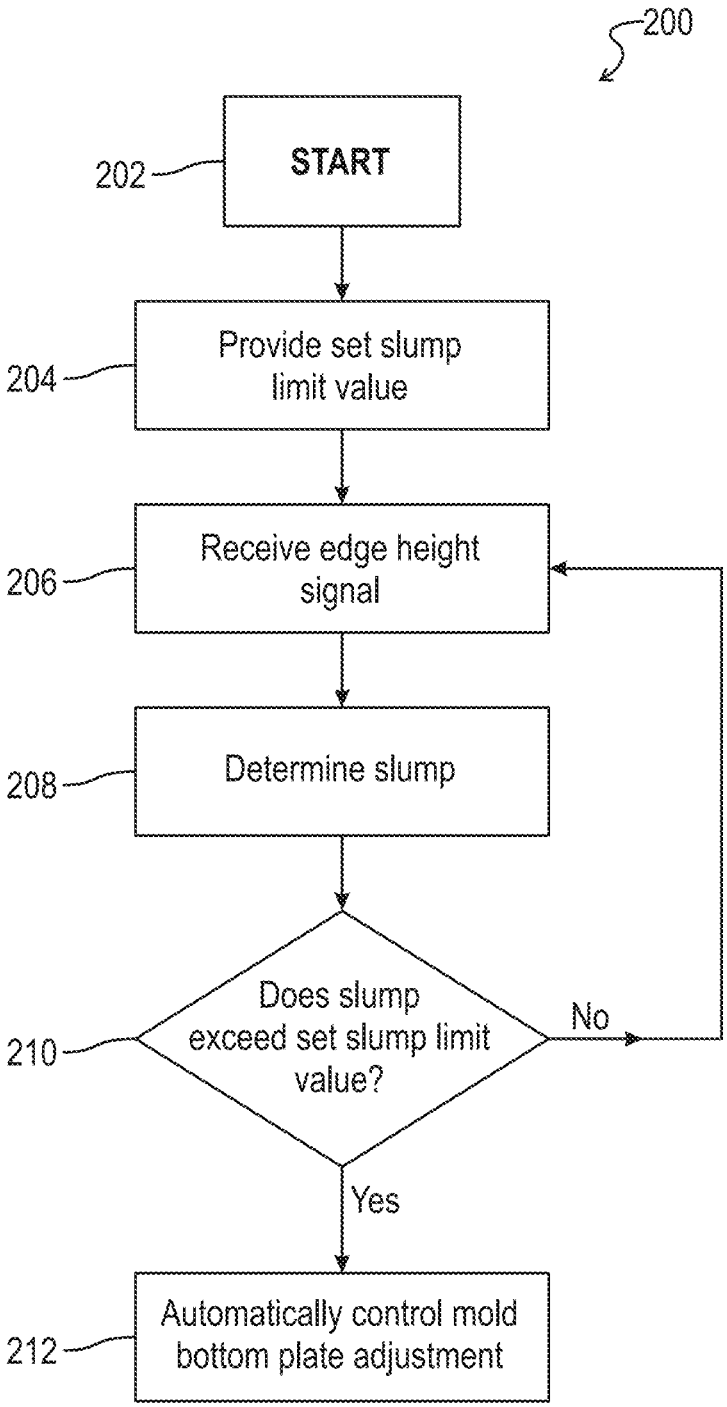
FIG. 14 is a first flow chart showing a basic process of automatic control of the actuator in response to the edge height signal to adjust the mold bottom plate and thereby adjust the slumping of the finished concrete product.
Figure 15:
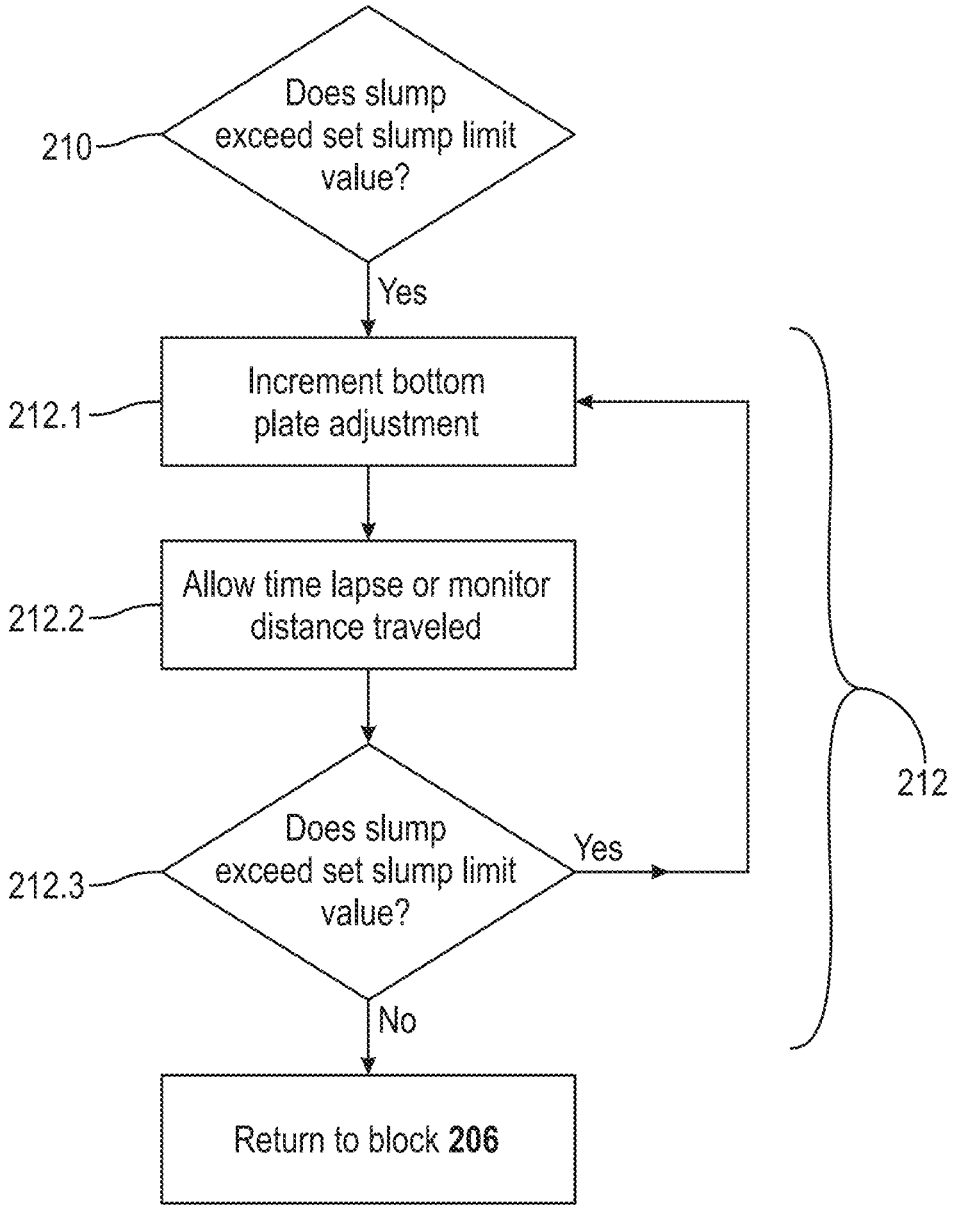
FIG. 15 is a further flow chart illustration an "iterative" process for automatic control.
Figure 16:
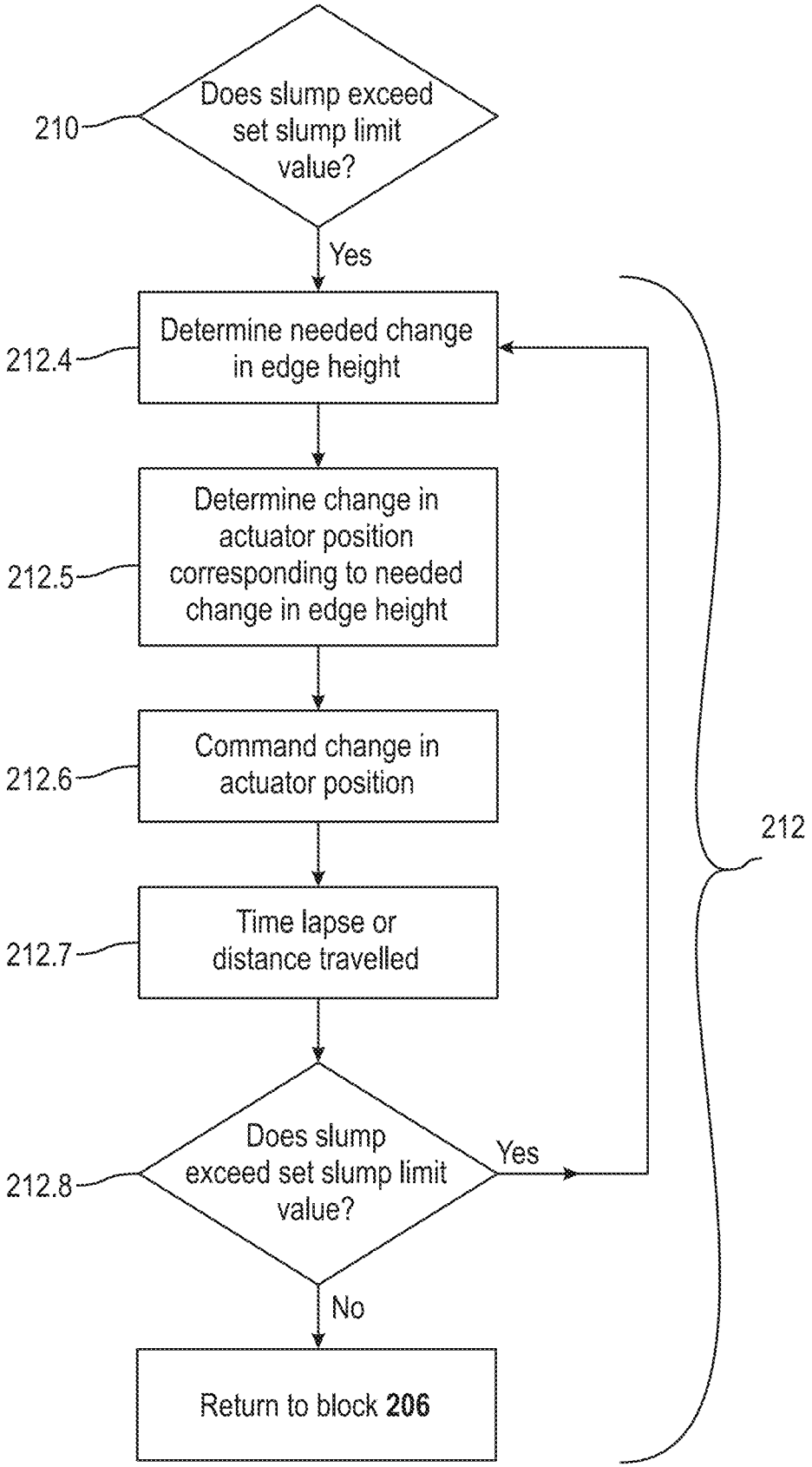
FIG. 16 is a further flow chart illustrating a "determinative" process for automatic control.

Flow Charts:

FIG. 14—Basic Control Method:

FIGS. 14-16 provide several flow charts summarizing the manner in which the controller 132 may be configured through programming of the software 152 to provide the functionality described herein.

FIG. 14 shows a flow chart for a basic process 200 which starts at block 202. At step 204 the controller 132 is provided with a set slump limit value defining a maximum allowable distance 48 by which the edge 46 of the finished concrete structure 16 is to be allowed to slump. The set slump limit value might for example be ⅜ inch (1 cm) or ¼ (6 mm) inch or such other value as is appropriate for the job at hand. The set slump limit value may be entered by the operator of the paving machine 100 via the operator interface 150 or it may be a default value preprogrammed in controller 132.

At step 206 the controller 132 may receive the edge height signal or signals 110S from the one or more edge height sensors 110.

At step 208 the controller 132 may determine the actual distance 48 by which the edge 46 of the newly formed concrete structure 16 is slumping. This may be done with any of the embodiments of the at least one edge height sensor 110 described above.

In one embodiment as schematically shown in FIG. 9, the distance 48 may be detected as a difference in height between a calibrated "zero slump" edge location 46' as compared to the actual detected edge location 46.

In other embodiments as schematically shown in FIGS. 10, 11 and 12, the distance 48 may be determined by determining a height of two or more points on the interior portion 116 of the newly formed concrete structure and projecting an imaginary line 118 through those points, then determining the distance 48 from the imaginary line 118 to the actual edge 46.

At step 210 a determination is made as to whether the actual slumping calculated in step 208 exceeds the set slump value provided in step 204.

If the actual slumping calculated in step 208 does not exceed the set slump value, then the process returns to step 206 and continues to monitor the edge height signal 110S.

If the actual slumping determined in step 208 exceeds the set slump value, then the process proceeds to step 212 wherein the controller 132 automatically controls the hydraulic smart cylinder 106 of the actuator assembly at least in part in response to the edge height signal 110S to adjust the height of the lateral edge portion 56*a* of the mold bottom plate 56 relative to the interior portion 56*b* of the mold bottom plate 56 to thereby adjust the height of the edge 46 of the finished concrete structure 16.

Two examples of the manner in which the automatic control of step 212 may be performed are summarized in the flow charts of FIGS. 15 and 16. The method of FIG. 15 will be referred to herein as an "iterative" method of control. The method of FIG. 16 will be referred to herein as a "determinative" method of control.

FIG. 15—Iterative Control:

FIG. 15 illustrates the iterative control implementation of step 212. In a first sub-step 212.1 upon determining that the slumping 48 exceeds the set slump limit, the controller 132 directs the hydraulic smart cylinder 106 to raise the height of the lateral edge portion 56*a* of the mold bottom plate 56 relative to the interior portion 56*b* of the mold bottom plate 56 by a first incremental amount, e.g. 0.1 inch (2.5 mm). Any incremental amount could be selected. The control of the movement of the lateral edge portion 56*a* is based on control of the extension of the hydraulic smart cylinder 106 which is known from the extension signal 108S from extension sensor 108. Based on the known geometry of the actuator assembly 104 and of the bottom plate 56 the controller 132 may be provided with the correlation between the extension of the hydraulic smart cylinder 106 and the height of the lateral edge portion 56*a* of the mold bottom plate 56.

Step 212.2 represents the passage of a predetermined time interval after the raising of the height of the lateral edge portion 56*a* of the mold bottom plate 56 by the first incremental amount. The controller 132 may receive a travel speed signal 156S from a speed sensor 156. The controller 132 may receive an elapsed time signal 158S from an internal clock 158. The predetermined time interval should be a time at least sufficient for the slip form paver apparatus 100 to travel a distance equal to a distance of the at least one height sensor 110 behind the slip form paver mold 24. Alternatively, instead of monitoring the travel speed and elapsed time, the controller may monitor the distance travelled by the paving machine 10 after the raising of the height of the lateral edge portion 56*a*. The distance travelled may be monitored with an odometer 160 schematically shown in FIG. 13, which sends a signal 160S to controller 132 representative of the distance traveled. Odometer 160 may be a mechanically driven odometer, or it may be based on GNSS or GPS signals.

In step 212.3, after the passage of the predetermined time interval, or the travelling of the predetermined distance, of step 212.2, a further determination is made to again determine whether the slumping 48 of the edge 46 of the finished concrete structure 16 exceeds the set slump limit. If the slumping 48 still exceeds the set slump limit, the process returns to step 212.1 and a further incremental adjustment is made in the height of the lateral edge portion 56*a* of the mold bottom plate 56.

If the slumping 48 is now less than the set slump limit, the process returns to step 206 and returns to monitoring of the edge height signal 110S.

FIG. 16—Determinative Control

FIG. 16 illustrates the determinative control implementation of step 212. In a first sub-step 212.4 upon determining that the slumping 48 exceeds the set slump limit the controller 132 determines the needed change in height of the edge 46 of the finished concrete structure. This may be calculated by comparing the distance 48 to the set slump limit. A further adjustment may be added. For example, if the distance 48 is calculated to exceed the set slump limit by 0.2 inch (5 mm) the controller may determine that the actuator should be adjusted so as to raise the height of the edge 46 by 0.4 inch (10 mm) so as to reduce the slumping to well below the set slump limit.

Then in step 212.5 the controller 132 determines the expected total change in height of the lateral edge portion 56*a* of the mold bottom plate 56 needed to cause the needed correction in height of the edge 46 of the concrete structure 16. This determination may for example be based upon a look up table of historical information for the specific slip form paver apparatus 100 showing prior measurements of slumping of the edge 46 resulting from one or more variables including actuator position, wetness of the concrete mixture, speed of paving, and any other relevant available information.

At step 212.6 the controller 132 then directs the determined change in height of the lateral edge portion 56*a* of the mold bottom plate 56 via a change in extension of the hydraulic smart cylinder 106.

Step 212.7 again represents the passage of a predetermined time interval, or the travelling of a predetermined distance, after the change in the height of the lateral edge portion 56*a* of the mold bottom plate 56. The predetermined time interval should be a time at least sufficient for the slip form paver apparatus 100 to travel a distance equal to a distance of the at least one height sensor 110 behind the slip form paver mold 24.

In step 212.8, after the passage of the predetermined time interval, or the travelling of the predetermined distance, of step 212.6, a further determination is made to again determine whether the slumping 48 of the edge 46 of the finished concrete structure 16 exceeds the set slump limit. If the slumping 48 still exceeds the set slump limit, the process returns to step 212.4 and a further determination is made of a further needed change in height of the edge 46 of the finished concrete structure.

If the slumping 48 is now less than the set slump limit, the process returns to step 206 and returns to monitoring of the edge height signal 110S.

An additional feature which may be provided by the controller 132 is an operator warning in the event the automatic slump control system is unable to bring the detected slump within the set slump limit value. For example, if the actuator assembly 104 has raised the lateral edge portion 56*a* to the maximum possible value, and excessive slump is still detected, the controller 132 may send an audible or visual warning to the operator at the operator's platform 36.

The controller 132 may also adjust other machine parameters which affect the slumping of the edge 46 of the concrete structure 16. For example, the controller 132 may reduce the energy input into the vibrators 25 adjacent the lateral outer edges of the slip form mold 24 by reducing their frequency of vibration thereby reducing the liquefaction of the concrete material in that area and reducing the tendency of the concrete to slump after exiting the mold 24. The controller 132 may monitor the frequency of vibration of vibrators 25 by receiving a frequency signal 27S from a vibrator frequency sensor 27 (see FIG. 13). The controller 132 may send a command signal 25S to the vibrators 25. For example, the controller may be programmed such that if the actuator assembly 104 has raised the lateral edge portion 56*a* to the maximum possible value, or to or beyond some other preset value, and excessive slump is still detected, the controller 132 may send the control signal 25S to the vibrators 25 instructing the outer vibrators to reduce their frequency of vibration. This control can be in a closed loop control similar to that described above for the adjustment of position of the actuator assembly 104, i.e. it can either be an iterative process or a determinative process.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A slip form paver apparatus configured to move in a paving direction across a ground surface for forming concrete into a newly formed concrete structure, the slip form paver apparatus comprising:
- a main frame;
- a slip form paver mold supported from the main frame and including:
  - a mold bottom plate configured to form a top surface of the newly formed concrete structure, the mold bottom plate including an interior portion and a lateral edge portion, the lateral edge portion being deflectable up and down relative to the interior portion;
  - at least one side form assembly configured to close the slip form paver mold on at least one lateral side adjacent the lateral edge portion of the mold bottom plate; and
  - an actuator assembly connected to the lateral edge portion of the mold bottom plate for deflecting the lateral edge portion of the mold bottom plate up and down relative to the interior portion of the mold bottom plate;
- at least one edge height sensor configured to generate an edge height signal corresponding to a height of an edge of the newly formed concrete structure and to thereby detect a slumping of the edge of the newly formed concrete structure behind the slip form paver mold; and
- a controller communicatively coupled to the at least one edge height sensor and to the actuator assembly, the controller being configured to:
  - receive the edge height signal;
  - determine whether any slumping of the edge of the newly formed concrete structure exceeds a set slump limit; and
  - automatically control the actuator assembly at least in part in response to the edge height signal to adjust the height of the lateral edge portion of the mold bottom plate relative to the interior portion of the mold bottom plate and thereby adjust the height of the edge of the newly formed concrete structure so that any slumping of the edge of the newly formed concrete structure is within the set slump limit.

2. The slip form paver apparatus of claim 1, wherein:
- the at least one edge height sensor is configured to detect a change in height of the edge of the newly formed concrete structure relative to the main frame.

3. The slip form paver apparatus of claim 1, wherein:
- the at least one edge height sensor is configured to detect a difference in the height of the edge of the newly formed concrete structure relative to a height of an interior portion of the newly formed concrete structure.

4. The slip form paver apparatus of claim 3, wherein:
- the at least one edge height sensor includes an array of sensors extending transversely to the paving direction.

5. The slip form paver apparatus of claim 4, wherein:
- the array of sensors extends substantially perpendicular to the paving direction.

6. The slip form paver apparatus of claim 3, wherein:
- the at least one edge height sensor includes a scanning sensor configured to scan in a scanning direction extending transversely to the paving direction.

7. The slip form paver apparatus of claim 6, wherein:
- the scanning sensor is configured such that the scanning direction extends substantially perpendicular to the paving direction.

8. The slip form paver apparatus of claim 1, further comprising:
- at least one trailing side plate trailing behind the at least one side form assembly; and
- wherein the at least one edge height sensor is located behind the at least one trailing side plate.

9. The slip form paver apparatus of claim 1, further comprising:
- an actuator assembly position sensor configured to detect a position of the actuator assembly.

10. The slip form paver apparatus of claim 9, wherein:
- the controller is configured to:
  - upon determining that the slumping exceeds the set slump limit, raise the height of the lateral edge portion of the mold bottom plate relative to the interior portion of the mold bottom plate a first incremental amount;
  - after a predetermined time interval has passed, or after the slip form paver apparatus has traveled a predetermined distance, after the raising of the height of the lateral edge portion of the mold bottom plate by the first incremental amount, again determine whether the slumping of the edge of the newly formed concrete structure exceeds the set slump limit; and
  - if the slumping is determined to still exceed the set slump limit, raise the height of the lateral edge portion of the mold bottom plate relative to the interior portion of the mold bottom plate a further incremental amount.

11. The slip form paver apparatus of claim 10, wherein:
- the predetermined time interval is a time at least sufficient for the slip form paver apparatus to travel a distance equal to a distance of the at least one edge height sensor behind the slip form paver mold.

12. The slip form paver apparatus of claim 9, wherein:
- the actuator assembly includes a smart hydraulic cylinder including an integral extension sensor for detecting an extension value of the smart hydraulic cylinder, the integrated extension sensor being the actuator assembly position sensor.

13. The slip form paver apparatus of claim 9, wherein:
- the controller is configured to:
  - determine based at least in part on the edge height signal a needed change in height of the lateral edge portion of the mold bottom plate relative to the interior portion of the mold bottom plate necessary to correct the slumping of the edge of the newly formed concrete structure behind the slip form paver mold; and direct the actuator assembly to effect a change in actuator assembly position corresponding to the needed change in height of the lateral edge portion of the mold bottom plate relative to the interior portion of the mold bottom plate.

14. The slip form paver apparatus of claim 1, wherein:

the controller is further configured to send a warning to an operator of the slip form paver apparatus in an event where slumping of the edge of the newly formed concrete structure is still in excess of the set slump limit after adjustment of the height of the lateral edge portion of the mold bottom plate relative to the interior portion of the mold bottom plate to or beyond a predetermined limit.

15. The slip form paver apparatus of claim 1, wherein:

the apparatus further includes an array of vibrators in front of the slip form mold; and the controller is further configured, in an event where slumping of the edge of the newly formed concrete structure is still in excess of the set slump limit after adjustment of the height of the lateral edge portion of the mold bottom plate to or beyond a predetermined limit, to reduce vibrational frequency of one or more of the vibrators.

16. A method of operating a slip form paver apparatus, comprising:

monitoring a height of a lateral edge of a newly formed concrete structure formed by the slip form paver apparatus with at least one edge height sensor;

automatically determining with a controller whether any slumping of the lateral edge of the newly formed concrete structure exceeds a set slump limit; and automatically adjusting with the controller a height of a lateral edge portion of a mold bottom plate of the slip form paver apparatus relative to an interior portion of the mold bottom plate if any slumping of the lateral edge of the newly formed concrete structure exceeds the set slump limit and thereby adjusting the height of the lateral edge of the newly formed concrete structure so that any slumping of the edge of the newly formed concrete structure is within the set slump limit.

17. The method of claim 16, wherein:

the monitoring step further includes detecting a change in height of the lateral edge of the newly formed concrete structure relative to a main frame of the slip form paver apparatus.

18. The method of claim 16, wherein:

the monitoring step further includes detecting a difference in height of the lateral edge of the newly formed concrete structure relative to an interior portion of the newly formed concrete structure.

19. The method of claim 16, wherein:

the automatically adjusting step includes adjusting an actuator assembly connected to the lateral edge portion of the mold bottom plate.

20. The method of claim 19, wherein:

the automatically adjusting step includes detecting a position of the actuator assembly with an actuator assembly position sensor.

21. The method of claim 16, wherein the automatically adjusting step includes:

upon determining that the slumping exceeds the set slump limit, raising the height of the lateral edge portion of the mold bottom plate relative to the interior portion of the mold bottom plate a first incremental amount;

after a predetermined time interval has passed, or after the slip form paver apparatus has traveled a predetermined distance, after the raising of the height of the lateral edge portion of the mold bottom plate by the first incremental amount, again determining whether the slumping of the edge of the newly formed concrete structure exceeds the set slump limit; and if the slumping is determined to still exceed the set slump limit, raising the height of the lateral edge portion of the mold bottom plate relative to the interior portion of the mold bottom plate a further incremental amount.

22. The method of claim 21, wherein:

the predetermined time interval is a time at least sufficient for the slip form paver apparatus to travel a distance equal to a distance of the at least one edge height sensor behind the mold bottom plate.

23. The method of claim 16, wherein the automatically adjusting step includes:

determining based at least in part on an edge height signal from the at least one edge height sensor a needed change in height of the lateral edge portion of the mold bottom plate relative to the interior portion of the mold bottom plate necessary to correct the slumping of the edge of the newly formed concrete structure; and directing an actuator assembly to effect a change in actuator assembly position corresponding to the needed change in height of the lateral edge portion of the mold bottom plate relative to the interior portion of the mold bottom plate.

24. The method of claim 16, further comprising:

automatically sending a warning to an operator of the slip form paver apparatus in an event where slumping of the edge of the newly formed concrete structure is still in excess of the set slump limit after adjustment of the height of the lateral edge portion of the mold bottom plate relative to the interior portion of the mold bottom plate to or beyond a predetermined limit.

25. The method of claim 16, further comprising:

automatically reducing a vibrational frequency of one or more vibrators of the slip form paver apparatus in front of the slip form mold to reduce an energy input by the one or more vibrators adjacent a laterally outer edge of the slip form mold, in an event where slumping of the edge of the newly formed concrete structure is still in excess of the set slump limit after adjustment of the height of the lateral edge portion of the mold bottom plate to or beyond a predetermined limit.

* * * * *